United States Patent [19]

Schramm

[11] 4,270,461

[45] Jun. 2, 1981

[54] PRESENTATION STANDS FOR THE SORTED EXHIBITION OF GOODS

[75] Inventor: Werner Schramm, Munich, Fed. Rep. of Germany

[73] Assignee: PFP-Anstalt fur Produktentwicklung und Verwertung

[21] Appl. No.: 21,903

[22] Filed: Mar. 19, 1979

[30] Foreign Application Priority Data

Mar. 20, 1978 [DE] Fed. Rep. of Germany ..... 2812066
Feb. 22, 1979 [DE] Fed. Rep. of Germany ..... 2906939

[51] Int. Cl.[3] ..... A47B 41/04
[52] U.S. Cl. ..... 108/31; 211/40
[58] Field of Search ..... 108/31, 13, 28, 60; 211/40, 41, 42, 184, 131, 163; 248/309, 176, 175, 121

[56] References Cited

U.S. PATENT DOCUMENTS

| | | | |
|---|---|---|---|
| 1,277,599 | 9/1918 | Johnson | 108/31 X |
| 1,647,039 | 10/1927 | Fischer | 248/309 |
| 2,926,788 | 3/1960 | Jacobson | 108/31 X |
| 2,980,261 | 4/1961 | Young, Jr. | 108/31 X |
| 3,092,256 | 6/1963 | Vernik | 211/40 |
| 3,658,185 | 4/1972 | Jacobson | 211/40 |

*Primary Examiner*—Roy D. Frazier
*Assistant Examiner*—Peter A. Aschenbrenner
*Attorney, Agent, or Firm*—Hill, Van Santen, Steadman, Chiara & Simpson

[57] ABSTRACT

Goods holders are provided for use on upright stands or surfaces, such as walls, and designed for the display of goods in upright positions. The goods holders consist of brackets with a plurality of spaced yokes and arranged in superimposed pairs with the upper yoke of each pair receiving goods therebetween and the lower yokes of each pair providing supports for the goods depending from the upper yokes. The yokes lie in spaced tiers with adjacent tiers having yokes circumferentially offset so that the lower yokes underlie the spaces between the upper yokes.

16 Claims, 9 Drawing Figures

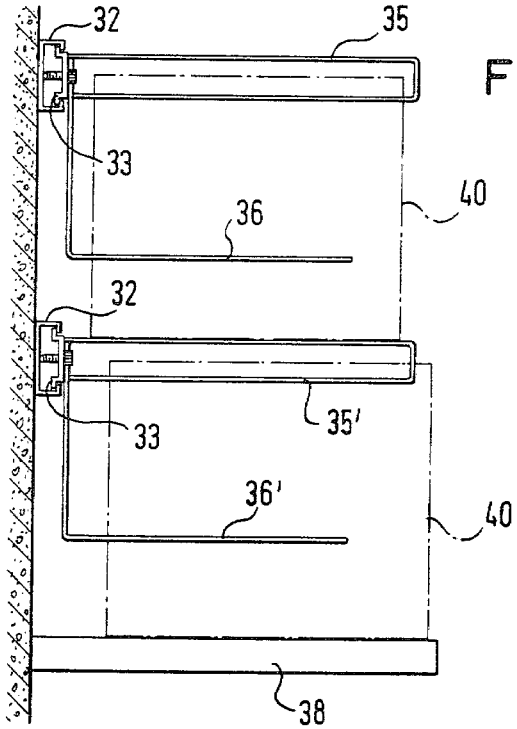
FIG. 6
FIG. 9
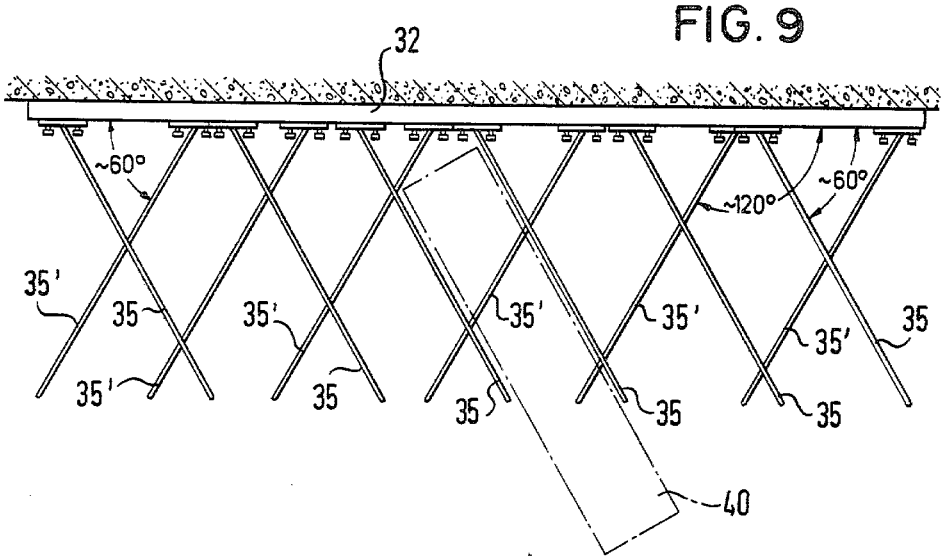

PRESENTATION STANDS FOR THE SORTED EXHIBITION OF GOODS

BACKGROUND OF THE INVENTION

1. Field of the Invention

The present invention relates to a presentation or display stand for the sorted exhibition of goods packed, preferably, in flat packages. It consists of several goods-holders superimposed on a support means, which may consist of a vertical stand or a vertical surface such as a wall.

2. Description of the Prior Art

Upon the sale of goods, particularly upon the sale of textiles, the aim is to set up the goods in corresponding display stands, arranged to enhance visibility in order to both stimulate the purchase and facilitate the selection of the goods. In addition to its function of enhancing the visibility of the goods, as many goods as possible are to be accommodated in as small a space as possible. As a rule, in the case of goods packed in flat packages, the front side of the package carries the description of the goods and advertising in the form of visual designs. It is therefore desirable that this front side remain visible upon the presentation of the goods.

In the case of the known basket-type goods holders, the flat packages of goods are set up adjacent to one another in the basket containing the goods, so that the front side of the package, which is provided with the description of the goods or the advertising, is covered by the adjacent packages. Finally, in the case of a full basket of goods, this front side will not be seen absent physically moving some of the goods. A further disadvantage of this type of display exists where, in a partially filled condition, the goods are not held standing vertically. Individual packages of goods may fall over, and through handling by the purchaser upon examining the goods, the orderly arrangement is very rapidly lost.

Such a presentation stand is known from the Germany specification No. 2,256,722 which carries on a stand a plurality of goods holders arranged one above the other. These good holders are constructed in the form of baskets, in which the individual packages of goods may be arranged, standing vertically adjacent to one another.

SUMMARY OF THE INVENTION

For the presentation and sale of goods, it is of great advantage if there is always at least one front side containing the advertising messages and the generic description fully visible. The object forming the basis of this invention is therefore to furnish a presentation stand of the type previously mentioned, in which wares packed in flat packages may be spatially arranged closely adjacent to one another, but in a manner whereby the front side of a package of goods containing the product identification and advertising is always visible. In this connection, it should be noted that even upon the taking out of individual packages of the goods from the goods holder, the rest of the packages will remain standing in the provided arrangement without difficulty.

This object is solved according to the invention in that the goods holder consists of two or more, (preferably three or four), brackets at the same angular distances from one another. The brackets extend horizontally from one another and away from the stand column. Yokes proceed from the brackets and extend comb-like in the plane of the brackets. The yokes project, at uniform spacings from one another, into the particular surface area enclosed by two adjacent brackets. The two or more goods holders are arranged in such manner that the yokes of the goods holders vertically superimposed, extend crosswise relative to one another.

Advantageously, in the case of a display stand constructed according to the features of the invention, the superimposed yokes extending crosswise to one another enable the retail goods to stand up on the lower goods holder and be held tight in the upper goods holder, between the individual yokes. Thereby, a stack of goods may be arranged consecutively, whereby the outside package of goods with the name of the goods and the advertising message remains visible. Upon removal of the articles, this invention enables all of the remaining goods to maintain an upright position. They are held tight in this position and cannot fall over. According to an advantageous embodiment of the invention, the brackets extend out from a base which may be vertically adjusted relative to the central support column. By means of this arrangement, the spacing of the goods holder may be adapted to the different sizes of the individual packages, so that the display stand is adaptable to all package sizes. According to the height of the support column, more or fewer pairs of goods holders may be arranged so that in a very restricted space, a large number of individual packages may be accommodated.

According to the number of brackets, there is a corresponding number of groups of goods which may be displayed, each requiring two goods holders with goods arranged for survey. It is provided that the cross-section of the base stand for those stands having goods holders adjustable as to height and where the goods holder has three brackets is hexagonal, and where the goods holder has four brackets, the cross-section of the base is rectangular. In this manner, the bracket will be flat against the outside of the stand column, and may be more easily held there when the appropriate height adjustment is made.

The type of brackets as well as the U-shaped wire yokes may be as desired. However, the invention provides for an especially advantageous embodiment wherein the brackets consist of vertically standing flat material to which are fixed, standing vertically, U-shaped wire yokes. The free ends of the side of the yoke being attached to the bracket, one attached on the upper portion of the bracket and the other on the lower edge of the bracket. With such an embodiment, it is also provided that the brackets themselves are constructed as vertically standing, U-shaped support yokes. The free ends of the wire yoke are connected to the top and bottom portions of the U-shaped bracket.

When it is desired that the display stand is to permit a rotating view of the goods, it is further provided that the two cooperating goods holders are attached together. The torsion resistant connection is most conveniently located in the area of the base.

As the flat packages of different goods vary in thickness, it is desirable to be able to adapt the spacings of the individual yokes from one another to match the thickness of the different packages. The invention therefore provides that the brackets consist of profile rails or tracks, in which the yokes are inserted arrestably, in different or similar spacings from one another. Through this measure, it is possible to adapt the position of the yokes to the thickness of the package, so that within one display stand, goods packages of different thickness may be accommodated without space being wasted, which would be otherwise unavoidable when using uniform spacings of the yoke with goods packages having substantially less thickness than the yoke spacings in which they are sorted.

According to a special embodiment of the invention, it is provided that the track has a C-shaped cross-section in which a complementary-shaped foot member is insertable and which is attached to and carries the yoke.

The storage and presentation of goods according to the present invention is, however, not limited to a display stand on a vertically standing column. This is also applicable to a display stand consisting of several goods holders which are fixed to a wall.

It consists of two or more tracks extending horizontally, the pairs being vertically superimposed. From the tracks extend comb-like yokes which are arranged and fixed in such a manner that the yokes of the pair of goods containers extend crosswise relative to one another. This track may, in an advantageous manner, likewise have a C-shaped cross-section, in which a complimentarily formed foot member carrying the yoke is insertable.

Such a display stand is useful not only for application in connection with a wall, but it also may be applied to a free standing shelf. In the latter case, the tracks are fixed in any conventional manner on the shelf supports.

When the tracks are all arranged in a plane, as for example on a wall or a shelf, a certain angular arrangement of the yokes may be provided upon the fastening of the yokes on the foot members, (slidable in the tracks). On one of the goods holders, the yokes extend from the foot member at an angle ranging from approximately 30° to approximately 60° to the plane of the track, and that on the vertically adjacent goods holder, lying either thereabove or therebelow, the yokes extend from the foot member at an angle of from approximately 120° to approximately 150° to the plane of the track. This vertical alternation is continued where there are multiple pairs of goods holders.

According to a further embodiment of the invention, it is provided that on the foot member, in the plane of the yoke or directly beside the same, a further L-shaped yoke extending parallel to the plane of a U-shaped yoke, is arranged and suspended downwardly therefrom. With an embodiment of such a type, additional lateral support is provided. This is especially useful for arrangements having relatively large spacing between the superimposed goods holders. Thereby additional protection against lateral shifting or tilting is obtained.

A further advantageous embodiment of the invention provides that instead of the yoke and the further L-shaped yoke, a separation plate is fixed on the foot member. This separating plate assumes both the separating as well as also the holding function of the yoke. This is especially advantageous in the separation of goods, which have very different heights.

The display stand according to the invention is adapted to the separation of textiles packed for example in flat packages of goods. Of course, it may also be used for the presentation and classification of books and other flat objects. Where the particular goods are pressure-sensitive, the edges may be protected against deformation by the wire edges of the yoke, this is especially a problem with books. An alternate embodiment of this invention provides a supportive strip. The strips are attached to the yokes or the plates along the upper edge thereof. These deposit strips may consist of a plate which may be pinned or placed on top of one or more yokes or plates.

Various other objects, advantages, and features of the present invention will become readily apparent from the ensuing detailed description and the novel features will be particularly pointed out in the appended claims.

BRIEF DESCRIPTION OF THE DRAWINGS

FIG. 6 is an elevational view of two tracks vertically superimposed on a wall having yokes inserted therein.

FIG. 9 shows a vertical perspective view of an alternate embodiment of the invention with the tracks arranged on a vertical plane.

DESCRIPTION OF THE PREFERRED EMBODIMENTS

Figure 1:
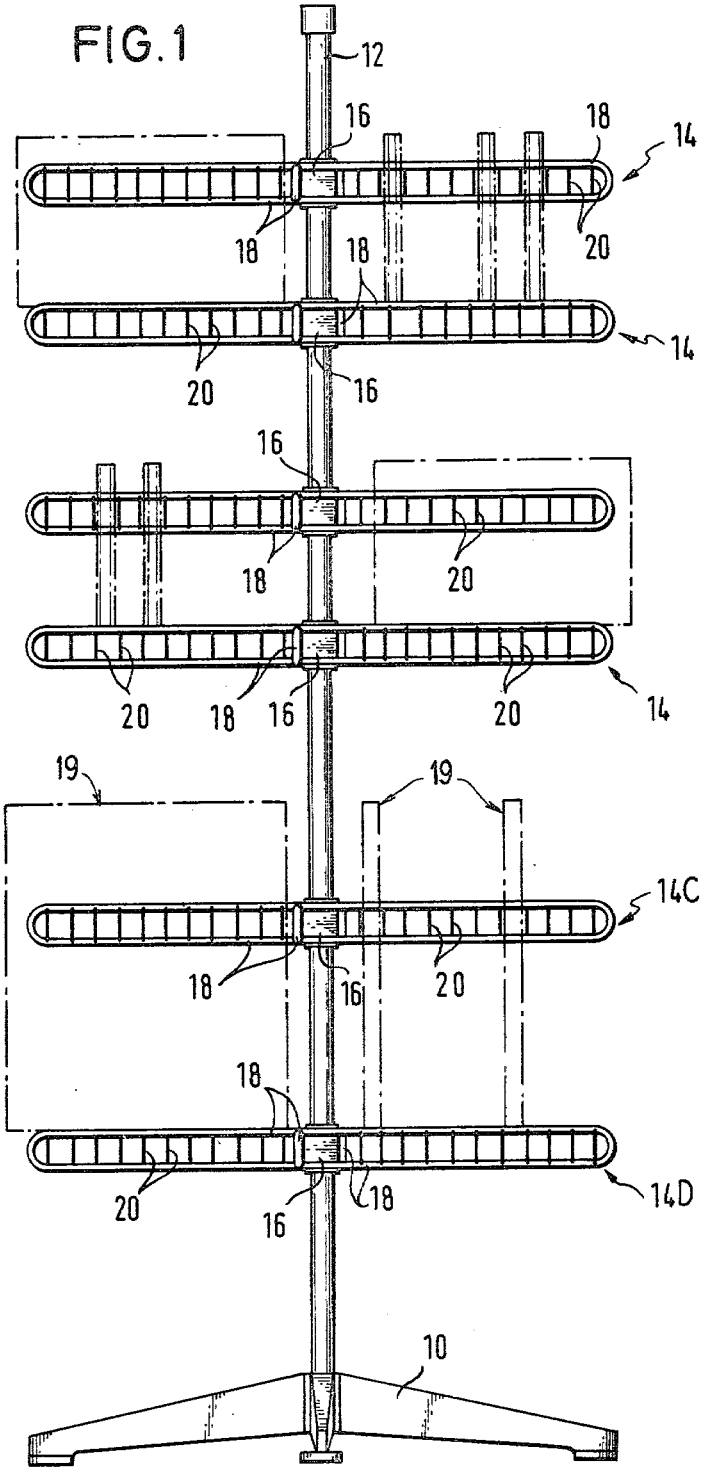
FIG. 1 is a side elevational view of a presentation stand according to the invention, with several goods holders arranged pairwise, superimposed, for flat packages of goods of different sizes, which are shown in phantom.

FIG. 1 shows a display stand with a foot 10 and a column 12, on which goods holders 14 are arranged according to the invention. The goods holders 14 may be constructed as four-part goods holders 14A, as they appear from the perspective showing according to FIG. 2.

Figure 2:
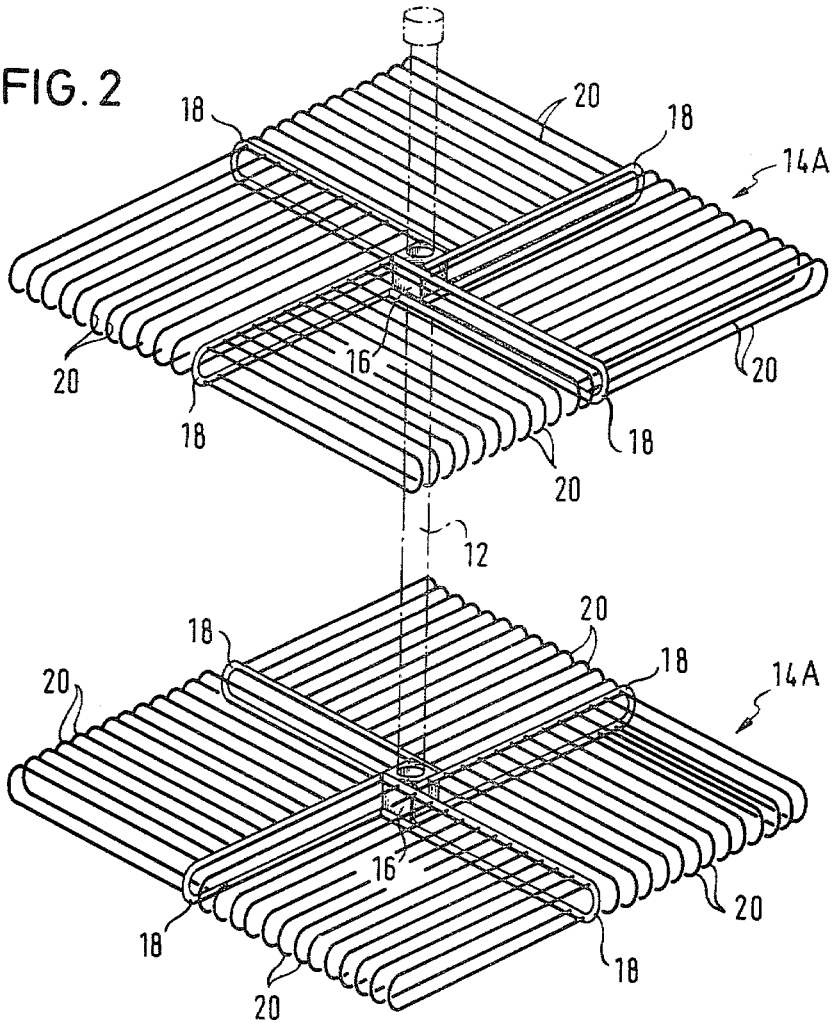
FIG. 2 shows two four-part goods holders lying superimposed, in perspective view, with an arrangement provided for the reception of flat packages of goods.

As is apparent from both FIGS. 1 and 2, each goods holder 14, 14A consists of a base 16 with brackets 18 extending out therefrom. On the brackets 18 are fixed in each case U-shaped yokes 20, which extend parallel to an adjacent bracket 18. These U-shaped yokes 20 are fixed at such spacing on the bracket that between the yokes at each one flat package of goods 19, (FIG. 1), is insertable.

Through the pairwise grouping of two goods holders 14A, 14A lying vertically superimposed and rotationally shifted with respect to one another, as is shown in the perspective view according to FIG. 2, the yokes 20 of the two goods holders 14A, 14A extend crosswise to one another in each sector formed by two adjacent brackets 18. This arrangement permits, as may be observed from FIG. 1, inserting a pair of packages 19, 19 in between the yokes 20 of the upper goods holder 14C in each case. The packages 19, 19 which lie on the yokes 20 of the correlated lower goods holder 14, 14D. Thereby the ability to consecutively arrange, in each sector defined by the brackets 18, a plurality of flat packages of goods 19, all of which lie on the yokes 20 of the correlated lower goods holder 14D. With this arrangement a dense packing of the goods on a display FIG. 6, it is also apparent that with the aid of the L-shaped yokes 36, 36' a shifting or tilting of the package to the side may be prevented.

As support for the lower row of the packages 40', a shelf 38 or other such structure is provided according to FIG. 6.

As is disclosed in FIG. 9, the yokes 35, 35' are not perpendicular to the vertical from a plane containing the front surface of the foot members 33. Rather, on one row the yokes 35' are shifted to the right and on the vertically adjacent row the yokes 35 are shifted to the left. In both cases an angle of approximately 60° is formed with the foot member plane.

Figure 7:
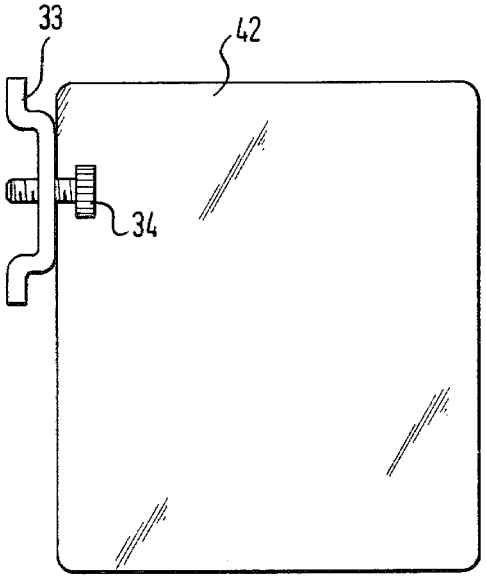
FIG. 7 is a side elevational view showing a separating plate fixed to a foot member.
Figure 8:
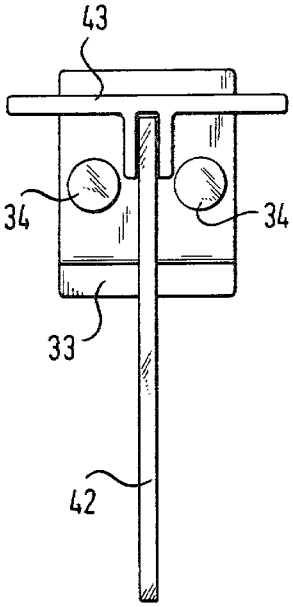
FIG. 8 is a front elevational view showing a separating plate fixed to a foot member with a deposit strip attached thereto.

In FIGS. 7 and 8 it is shown a further form of an embodiment of the invention. Instead of the U-shaped yoke 35 and L-shaped yoke 36, a separating plate 42 is attached to the foot member 33. The separating plate 42 may consist of a sheet metal plate or a plate of some synthetic material, (usually plastic). Transparent plates of synthetic material are particularly advantageous, as the outside of the packages remain visible through the plate. Upon the utilization of a synthetic material for the plate 42, the foot member 33 may also be produced out of a synthetic material. Thus, both the foot member 33 as well as the separating plate 42 may be produced in one molding process.

The display stand according to the invention is adapted for the presentation of flat packages of goods of all types, whether packaged in hard or soft materials. If upon the placement of the packages an indentation of the edge of the package lying on the lower goods holder is a problem, then, as shown in FIG. 8, a deposit strip 43 is provided. It may be attached to the upper rim of the separating plate 42 or on the U-shaped yoke 35, (not shown). This deposit strip 43 may have a T-shape and be individually attached to each plate 42. However, it may be in the form of a long plate, and be attached to several separating plates or yokes. Upon attachment of the deposit strips 43 to a U-shaped yoke, it is appropriate if both sides of the U-shaped yoke are held by the attachment groove of the deposit strip, thereby providing rotational stability on an axis about the extended yoke.

Figure 4:
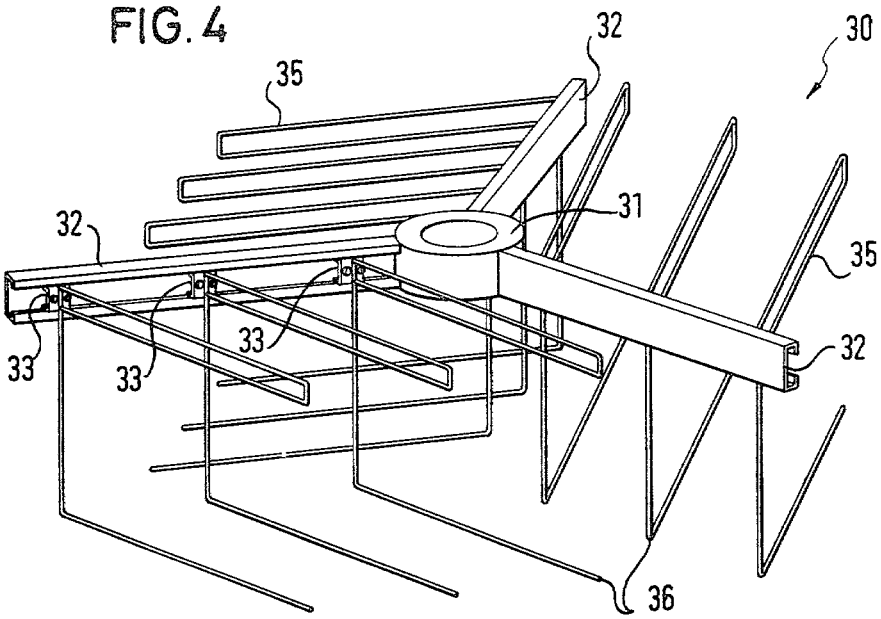
FIG. 4 is a perspective view showing an alternate goods holder, as it may be applied to a vertical stand.

Upon the construction of a display stand with goods holders 30 arranged superimposed in the stand column, according to FIG. 4, the deposit strips 43 may also be constructed as disks which are attached with a central bore on the stand column and lie loosely on the particular goods holder, (not shown).

While I have disclosed an exemplary structure to illustrate the principles of the invention, it should be understood that I wish to embody within the scope of the patent warranted hereon all such modifications as reasonably and properly come within the scope of my contribution to the art.

I claim as my invention:

1. A display stand for the sorted exhibition of goods in upright positions comprising:

an upright support;

a plurality of goods holders attached to and extending from said support in superimposed relation; and a plurality of spaced yokes attached to and projecting from each holder with the yokes of adjacent superimposed holders being circumferentially offset so that goods positioned in the spaces formed between upper yokes will be supported on the adjacent, offset lower yokes.

2. A display stand as defined in claim 1 and further comprising:

a base means attached to each of said holders and suitable for being received upon and attaching to said upright support in a height adjustable relationship.

3. A display stand as defined in claim 1 wherein said goods holders comprise:

at least two bracket means arranged at equal spacings from one another around said upright support and extending therefrom in a horizontal plane.

4. A display stand as defined in claim 3 wherein three bracket means are provided each said goods holder and said base means is hexagonal in cross-section through said horizontal plane.

5. A display stand as defined in claim 3 wherein four bracket means are provided each said goods holder and said base means is rectanglar in cross-section through said horizontal plane.

6. A display stand as defined in claim 3 wherein said bracket means consists of a vertically standing flat material and said yokes consist of U-shaped pieces of wire having two free ends, means attaching one of said free ends to an upper portion of said bracket means, and means attaching the other said free end to a lower portion of said bracket means.

7. A display stand as defined in claim 3 wherein said bracket means consists of U-shaped, vertically standing wire and said yokes consist of U-shaped wire having two free ends, means attaching an upper free end of said yoke to an upper wire portion of said bracket means, and means attaching a related lower free end to the lower portion of said bracket means.

8. A display stand as defined in claim 3 wherein said bracket means has tracks formed thereon.

9. A display stand as defined in claim 3 wherein said bracket means having a track formed thereon is C-shaped in cross-section.

10. A display stand as defined in claim 3 and further comprising:

a foot member insertable in said track and having means suitable for receiving said yokes.

11. A display stand as defined in claim 3 wherein the yokes in an upper goods holder extend at an angle in the range of from approximately 30° to approximately 60° from the bracket means in said horizontal plane of the goods holder, and the yokes in a goods holder adjacent to and disposed below said upper goods holder, extend at an angle in the range of from approximately 120° to approximately 150° from the bracket means in said horizontal plane of the lower goods holder.

12. A display stand as defined in claim 3 further comprising:

an L-shaped yoke attached to said bracket means and extending downwardly therefrom with a lower portion extending outwardly from a vertical plane containing said bracket means and parallel to said horizontal plane of the goods holder.

13. A display stand as defined in claim 1 and further comprising:

a supportive strip attached to an upper edge of said yokes, and having a flattened portion for receiving the bottom surface of the goods, whereby a yoke having a larger goods-receiving surface is provided.

14. A display stand as defined in claim 13 wherein said deposit strip consists of a sheet-form material, whereby several adjacent upper edges of said yokes may be simultaneously covered.

stand is possible in a conveniently arranged and orderly manner. The flat packages 19 are held tight by means of the yokes 20 in their vertical position. In addition, the front side with the advertising and descriptive label is always visible to the prospective purchaser.

As is apparent from FIG. 1, the goods holders of each pair are arranged vertically superimposed at a corresponding spacing according to the size of the packages of the goods. Thus by making height adjustments, an arrangement of the goods holders on the stand column offer the possibility of keeping the intermediary space, between the upper edge of the packages and the adjacent goods carrier located directly above, to a minimum. Thereby, with the aid of the display stand according to the invention, the available space may be utilized to the utmost.

Figure 3:
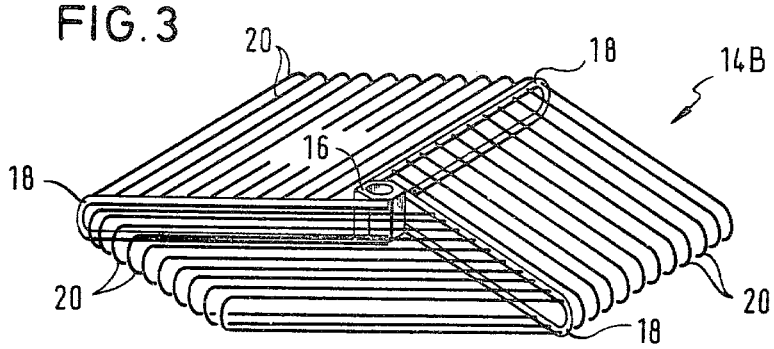
FIG. 3 is a view in perspective of a three-part goods holder.

In FIG. 3 a three-part goods holder 14B is shown, in which the brackets 18 extend at an angle of 120° relative to the bracket from which they project. The U-shaped yokes 20 extend parallel to the adjacent bracket 18. The yokes 20 project into the space lying between the adjacent brackets 18, which may be described as sectors of the goods holder 14B.

Although it is not shown in the drawing, goods holders with two brackets or more than four brackets may be constructed. It may be readily visualized that with an embodiment of a goods holder with two brackets, U-shaped yokes would extend from these brackets to both sides. By rotating the second member of the pair of goods holders by 90°, one may likewise obtain a crosswise arrangement of the yokes of the two goods holders of a pair. Thus the placement of the flat packages is possible in the before mentioned manner.

For a goods holder with five brackets, the latter extend at an angle of 72° to one another. The U-shaped yokes project into the resulting five sector areas. In using such five-part goods holders, the placement consists of a lateral stacking of the flat packages of goods, whereby the packages close to the stand are somewhat set back.

Although in the drawing this is not shown, the two goods holders 14 of a pair may be connected with one another to prohibit rotation relative to one another. For example, the base 16 of the upper goods carrier 14A is connected with the base 16 of the lower container 14B through a sleeve (not shown) in a stationary manner. With such an embodiment, the goods holder may be arranged pairwise on the stand column so that each pair is individually rotatable. Such a rotatable embodiment of the goods holders may substantially contribute to a more successful sales program.

The brackets 18 of the individual goods holders may be produced of a flat material which is welded to corresponding front surfaces of the base 16. The utilization of a U-shaped wire yoke for the bracket 18, as it is shown in the drawing, may prove particularly advantageous, whereby a relatively lighter goods holder may be produced. The yokes 20 are preferably likewise bent from a wire to form a U-shape, with the free ends welded on to the U-shaped wire yoke of the bracket. The free ends of each yoke are welded to the same bracket, but one end is welded to the top side of the U and the other free end of the yoke is welded to the bottom side of the U-shaped bracket.

Although in the drawing this is not shown, it is also possible to weld onto a flat or round rod, which is used as a bracket, finger shaped rods instead of the U-shaped wire yokes. This arrangement is particularly useful where the dimensions of the individual goods holders are relatively small for use with small packages. This type of embodiment is especially valuable for small packages of goods having low weight.

A three-part goods holder 30 shown in FIG. 4, together with further goods holders of the same type, is affixed on the stand column of a display stand, (not shown). The three-part goods holder 30 consists of a base 31, from which brackets extend in the form of profile rails or tracks 32. The three tracks 32 are offset to one another at an angle of 120°. The goods holder may, however, also be made in four parts, so that four tracks extend from a base and are offset to one another at an angle of 90°. In the C-shaped tracks 32, complementarily formed foot members 33 are insertable therein and designed to receive the yokes 35.

Figure 5:
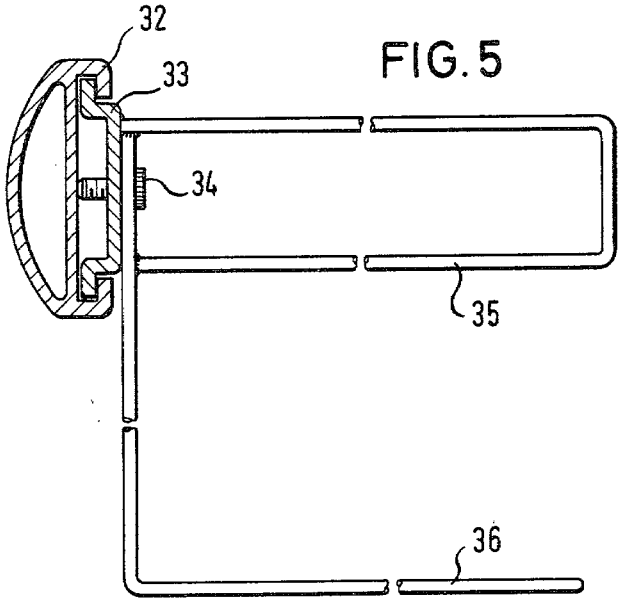
FIG. 5 is a view in plan of a section through a track which is utilizable as a bracket, and in which a yoke is inserted and fixed to a foot member.

The construction of a yoke fixed on a foot member 33 is apparent in detail from FIG. 5. From the same, it is shown that the foot member 33 consists of a short piece of formed material which is slidable into the track 32 with a front surface projecting slightly beyond the front plane of the track 32. With the aid of one or two stop screws or pins 34, the foot member 33 may be clamped to the track 32 at a desired point. From the front surface of the foot member 33 extends, at an angle to be described in greater detail in the following, two yokes, a U-shaped yoke 35, and an L-shaped yoke 36 which, as shown in this embodiment, are produced of wire.

Upon the construction of a display stand, two goods holders are pushed onto the stand column. They are arranged so that the vertical pairs of tracks have their open sides facing in opposite directions. Thereby, when the yokes are attached to the tracks using the foot member which is inserted therein, and project into the sector formed by the adjacent brackets, the yokes of a pair of goods holders intersect in a crosswise manner.

Upon the utilization of a goods holder 30 with three tracks 32 offset at an angle of 120°, it is suitable to correlate the U-shaped yoke 35 and the L-shaped yoke 36 on the foot member 33 in an angle of between 30° and 60° to the plane of the front surface of the foot member 33. With the form of embodiment shown in FIG. 4, the yokes 35, 36 extend at an angle of 45° to the front surface of the foot member 33, whereby, the yokes 35, 36 are swung to the left when viewed from the front surface of the foot member 33. Additionally, above and below the goods holder 30, (not shown in FIG. 4), are additional goods holders with the tracks 32 and the foot members 33 rotated 180° about a horizontal axis. In these goods holders, (not shown), the inserted yokes 35, 36 are swung to the right when viewed from the foot member 33. Thereby, arranged in a sector limited by the brackets, a plurality of goods packages lying adjacent to one another lie on the yokes of the goods holders disposed thereunder.

FIGS. 6 and 9 show a form of embodiment in which the tracks 22 are fixed in each case on a wall and vertically superimposed. In the tracks 32, the yokes 35, 36 are fixed in the foot members 33 with U-shaped yokes 35 and L-shaped yokes 36 at spacings corresponding in width to the packages of goods. In FIG. 6, the vertically superimposed placement is demonstrated, and in FIG. 9, the relationship between the yokes 35, 36 and the lower yokes 35', 36' is disclosed. With the aid of packages 40, 40' (shown in phantom), placed on the display stand, it may be seen that a package of goods held between two adjacent yokes in the upper row sets on the lower yoke series. From a showing according to 15. A display stand for the sorted exhibition of goods in upright positions comprising:

an upright support;

a plurality of goods holders attached to and extending from said support in superimposed relation, each of which comprise:

at least three bracket means arranged at equal spacings from one another around said upright support and extending therefrom in a horizontal plane;

a base means attached to each of said holders and suitable for being received upon and attaching to said upright support in a height adjustable relationship; and a plurality of spaced yokes attached to and projecting from each holder in a horizontal plane and the yokes of adjacent superimposed holders being offset so that goods positioned in the spaces formed between the upper yokes will be supported on the adjacent, offset lower yokes.

16. A display stand for the sorted exhibition of goods in upright positions comprising:

an upright support;

a plurality of goods holders attached to and extending from said support in superimposed relation; and a plurality of spaced separating plates attached to and projecting from each holder in a horizontal plane and the separating plates of adjacent superimposed holders being offset so that goods positioned in the spaces between the separating plates will be supported on the adjacent offset lower separating plates.

* * * * *